US006339412B1

(12) United States Patent
Lee

(10) Patent No.: US 6,339,412 B1
(45) Date of Patent: Jan. 15, 2002

(54) DEVICE AND METHOD FOR STABILIZING HORIZONTAL TRANSISTOR OF VIDEO DISPLAY DEVICE

(75) Inventor: Ji-Young Lee, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 08/877,478

(22) Filed: Jun. 16, 1997

(30) Foreign Application Priority Data

Jun. 21, 1996 (KR) ..... 96/22948

(51) Int. Cl.[7] ..... G09G 5/10

(52) U.S. Cl. ..... 345/14; 345/1.1; 345/213; 367/138; 327/2; 348/540; 348/547; 375/360

(58) Field of Search ..... 345/1.1, 14, 213; 367/138; 327/2; 348/540, 547; 375/360

(56) References Cited

U.S. PATENT DOCUMENTS 4,029,905 A * 6/1977 Abraham ..... 375/360
4,176,337 A * 11/1979 Aechter et al. ..... 367/138
4,263,615 A * 4/1981 Steinmetz et al. ..... 348/540
5,159,327 A * 10/1992 Yi ..... 345/213
5,264,800 A * 11/1993 Black ..... 327/2
5,438,245 A 8/1995 Kii et al. ..... 315/408
5,493,340 A 2/1996 Kim ..... 348/569
5,949,400 A * 9/1999 Kim ..... 345/147
6,025,817 A * 2/2000 Uno et al. ..... 345/1

* cited by examiner

*Primary Examiner*—Bipin Shalwala
*Assistant Examiner*—Vincent E. Kovalick
(74) *Attorney, Agent, or Firm*—Robert E. Bushnell, Esq.

(57) ABSTRACT

A stabilizing circuit for stabilizing a horizontal transistor of a video display device. The stabilizing circuit includes a transient state detector for detecting a transient state of a phase locked loop circuit in a horizontal drive circuit due to a change in an operation mode of a video card in a computer system. A micro-computer outputs vertical and horizontal synchronous signals with frequencies before the change in the operation mode of the video card when the transient state detector detects the transient state of the phase locked loop circuit. The transient state detector detects the transient state of the phase locked loop circuit according to a direct current level variation based on a phase difference between a horizontal synchronous signal from the micro-computer and a horizontal drive signal from the phase locked loop circuit. In addition, the micro-computer outputs vertical and horizontal synchronous signals with frequencies corresponding to the changed operation mode of the video card when the transient state detector detects no transient state of the phase locked loop circuit because the phase locked loop circuit is again operated at a phase locked state.

17 Claims, 5 Drawing Sheets

DEVICE AND METHOD FOR STABILIZING HORIZONTAL TRANSISTOR OF VIDEO DISPLAY DEVICE

CLAIM FOR PRIORITY

This application makes reference to, incorporates the same herein, and claims all benefits accruing under 35 U.S.C. §119 from an application for DEVICE AND METHOD FOR STABILIZING HORIZONTAL TRANSISTOR OF VIDEO DISPLAY APPARATUS earlier filed in the Korean Industrial Property Office on Jun. 21, 1996, and there duly assigned Ser. No. 22948/1996.

BACKGROUND OF THE INVENTION

1. Technical Field

The present invention relates to a video display device such as a multi-mode monitor for a computer system, and more particularly, relates to a device and process of stabilizing a horizontal transistor of the video display device in which the horizontal transistor can be stably operated with no damage when an operation mode of a video card in the computer system is changed for a visual display of a desired image on a screen.

2. Related Art

Generally, a display device such as a CRT type of monitor is a peripheral device which processes information data received from an information data system such as a computer system and provides a visual display of processed information data on a screen. Such a monitor is typically available in either black and white known as monochrome monitor or high resolution color known as color graphics adapter (CGA), video graphics adapter (VGA) and extended graphics adapter (XGA) monitor. Monochrome, CGA, EGA monitors provide a visual display of graphics data by processing digital signals. VGA monitors, by contrast, provide a visual display of graphics data by processing analog signals. In all display devices, the video signal is typically received from a video card installed in an information data system in accordance with vertical and horizontal synchronous signals for a visual display. Vertical and horizontal synchronous signals exhibit different frequencies according to different operation modes of the video card. For example, in a CGA mode, the vertical and horizontal synchronous signals exhibit frequencies of 60 Hz and 15.75 KHz, respectively. In a VGA mode, the vertical and horizontal synchronous signals exhibit frequencies of 60 Hz and 31.47 KHz, respectively. Similarly, in a XGA mode, the vertical and horizontal synchronous signals exhibit frequencies of 60 Hz and 48.36 KHz, respectively.

Various operation modes may be present in addition to the above operation modes. Likewise, the vertical and horizontal synchronous signals have different frequencies according to the various operation modes. When the operation mode of the video card in the computer system is changed to display a desired signal on the screen of the video display device, the video display device discriminates the changed operation mode on the basis of the frequencies of the vertical and horizontal synchronous signals from the video card and performs an operation in the discriminated operation mode.

A conventional display device generally includes a microprocessor which receives the vertical and horizontal synchronous signals from the video card to control the visual display of information data on a screen, and vertical and horizontal deflection circuits which respectively receive the vertical and horizontal synchronous signals to perform vertical and horizontal deflection, such that an electron beam generated from an electron gun of a CRT is deflected in a regular sequence from an upper left portion to a lower right portion of the CRT by way of a deflection yoke in order to form an image. Using high voltage technology, a high voltage generating circuit such as disclosed, for example, in U.S. Pat. No. 5,438,245 for High Voltage Generating Circuit issued to Kii et al., is included to stably supply a high voltage to an anode of the CRT for forming an image in response to a flyback pulse generated from the horizontal deflection circuit. A video amplifier then serves to amplify video signals R, G and B transmitted from the video card to approximately 40Vpp–60Vpp for providing energy to each picture.

In such a display device, deflection circuits perform either an electrostatic deflection using an electric field or an electromagnetic deflection using a magnetic field. As a result, an image is formed on the CRT type of monitor from the electron beam projected onto a fluorescent surface thereof and by flowing a toothed waveform of electric current into horizontal and vertical coils using the electromagnetic deflection. An example of such horizontal deflection circuit is disclosed in U.S. Pat. No. 4,263,615 for Horizontal Drive Circuit For Video Display issued to Steinmetz et al. Generally, the horizontal deflection circuit includes a horizontal drive circuit and a horizontal deflection output circuit, for generating an output horizontal deflection signal to a deflection yoke connector of the CRT monitor. The horizontal deflection output circuit typically includes a transformer for amplifying a horizontal drive signal and a horizontal transistor which operates in response to an output of the transformer to generate an output horizontal deflection signal.

When the operation mode of the video card is changed, however, the horizontal transistor becomes unstable during a transient state. As a result, the deflection yoke connector of the CRT monitor produces an unstable horizontal deflection magnetic field, and thereby causing an image displayed on a screen to be blurry and unstable. Moreover, a voltage level of a horizontal drive signal generated during a transient time may exceed a rated voltage level of the horizontal transistor which often can damage operation of the horizontal transistor.

SUMMARY OF THE INVENTION

Accordingly, it is therefore an object of the present invention to provide an improved video display device.

It is also an object to provide a video display device capable of stabilizing a horizontal transistor incorporated therein for stable operation.

It is another object to provide a process of stabilizing operation of a horizontal transistor in a video display device during a transient period when there is a change in operation mode of a video card installed in a computer system.

These and other objects of the present invention can be achieved by a stabilizing circuit for stabilizing a horizontal transistor of a video display device including a microcomputer for separating vertical and horizontal synchronous signals received from a video card in a computer system and discriminating an operation mode of the video card in response to frequencies of the separated vertical and horizontal synchronous signals so as to control entire operation of the video display device in a discriminated operation mode, a vertical drive circuit including a first phase locked loop circuit for performing a phase locked operation in response to the vertical synchronous signal to produce a vertical drive signal, a horizontal drive circuit including a second phase locked loop circuit for performing a phase locked operation in response to the horizontal synchronous signal to produce a horizontal drive signal, a vertical output circuit for generating a vertical deflection signal in response to the vertical drive signal from the first phase locked loop circuit and applying the vertical deflection signal to a deflection coil, and a horizontal output circuit for generating a horizontal deflection signal in response to the horizontal drive signal from the second phase locked loop circuit and applying the horizontal deflection signal to the deflection coil. The stabilizing circuit includes a transient state detection unit for detecting a transient state of the second phase locked loop circuit due to a change in the operation mode of the video card, and uses the micro-computer to generate vertical and horizontal synchronous signals with frequencies before the change in the operation mode of the video card when the transient state detection unit detects the transient state of the second phase locked loop circuit.

In accordance with another aspect of the present invention, a process of stabilizing a horizontal transistor of a video display device comprises: detecting vertical and horizontal synchronous signals from a video card installed in a computer system and discriminating whether detected vertical and horizontal synchronous signals exhibit frequencies corresponding to an operation mode of the video display device; generating control signals corresponding to the operation mode of the video display device to control the entire operation of the video display device in the corresponding mode, when the detected vertical and horizontal synchronous signals exhibit frequencies corresponding to the operation mode of the video display device; and generating vertical and horizontal synchronous signals with frequencies before a change in an operation mode of the video card when an interrupt signal is generated in response to the mode change.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

is

DETAILED DESCRIPTION OF THE PREFERRED EMBODIMENT

Figure 1:
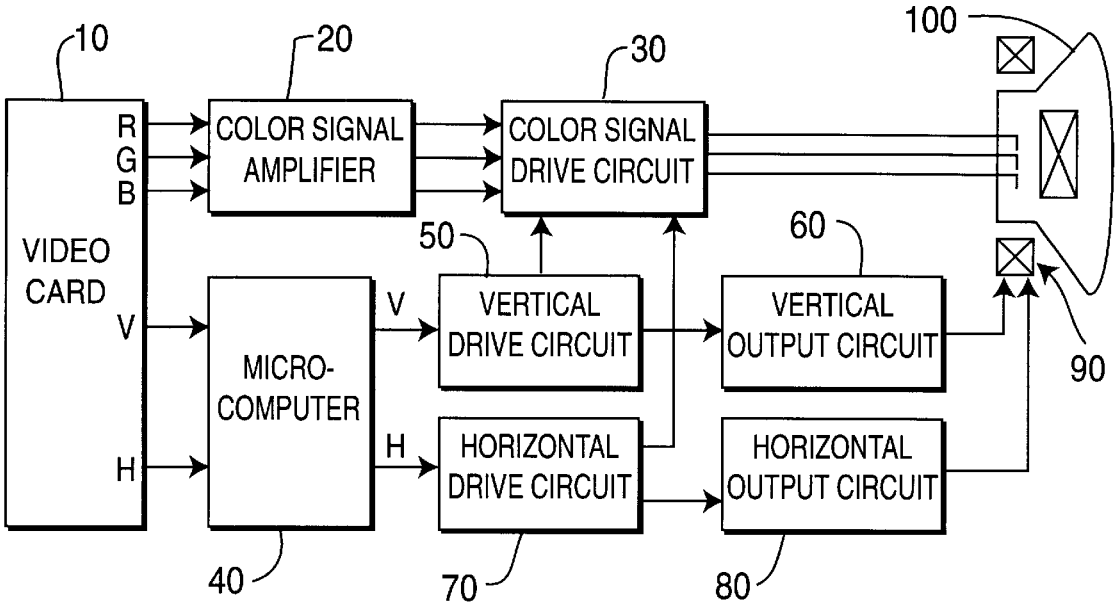
FIG. 1 is a block diagram of an exemplary video display device.

Referring now to the drawings and particularly to FIG. 1, which illustrates an exemplary video display device such as a CRT monitor for providing a visual display of information data from an information system such as a computer system on a screen. The video display device includes a video card 10 installed within a computer system (not shown) for supplying video signals such as red, green and blue color signals R, G and B and vertical/horizontal synchronous signals V and H required for image formation. A micro-computer 40 receives the vertical and horizontal synchronous signals V and H from the video card 10 in order to determine an operation mode of the video card 10 based upon the frequencies exhibited by the vertical and horizontal synchronous signals V and H. In addition, the micro-computer 40 also transfers the vertical and horizontal synchronous signals V and H to the vertical and horizontal drive circuits 50 and 70, respectively.

Vertical drive circuit 50 processes the vertical synchronous signal V from the micro-computer 40 to produce a vertical drive signal to the color signal drive circuit 30. Likewise, the horizontal drive circuit 70 processes the horizontal synchronous signal H from the micro-computer 40 to produce a horizontal drive signal to the color signal drive circuit 30. The color signal drive circuit 30 processes the video signals R, G and B from the video card 10 in response to the vertical and horizontal drive signals from the vertical and horizontal drive circuits 50 and 70.

The vertical and horizontal drive signals from the vertical and horizontal drive circuits 50 and 70 are also applied to vertical and horizontal output circuits 60 and 80, respectively. The vertical and horizontal output circuits 60 and 80 generate vertical and horizontal deflection signals in response to the applied vertical and horizontal drive signals and apply the vertical and horizontal deflection signals to a deflection coil 90 mounted to a cathode ray tube (CRT) 100 to generate vertical and horizontal deflection magnetic fields, respectively.

The CRT 100 generates electron beams in response to the output signals from the color signal drive circuit 30. The generated electron beams are deflected vertically and horizontally by the vertical and horizontal deflection magnetic fields generated by the deflection coil 90, thereby allowing a desired picture to be displayed on a screen of the CRT 100.

Figure 2:
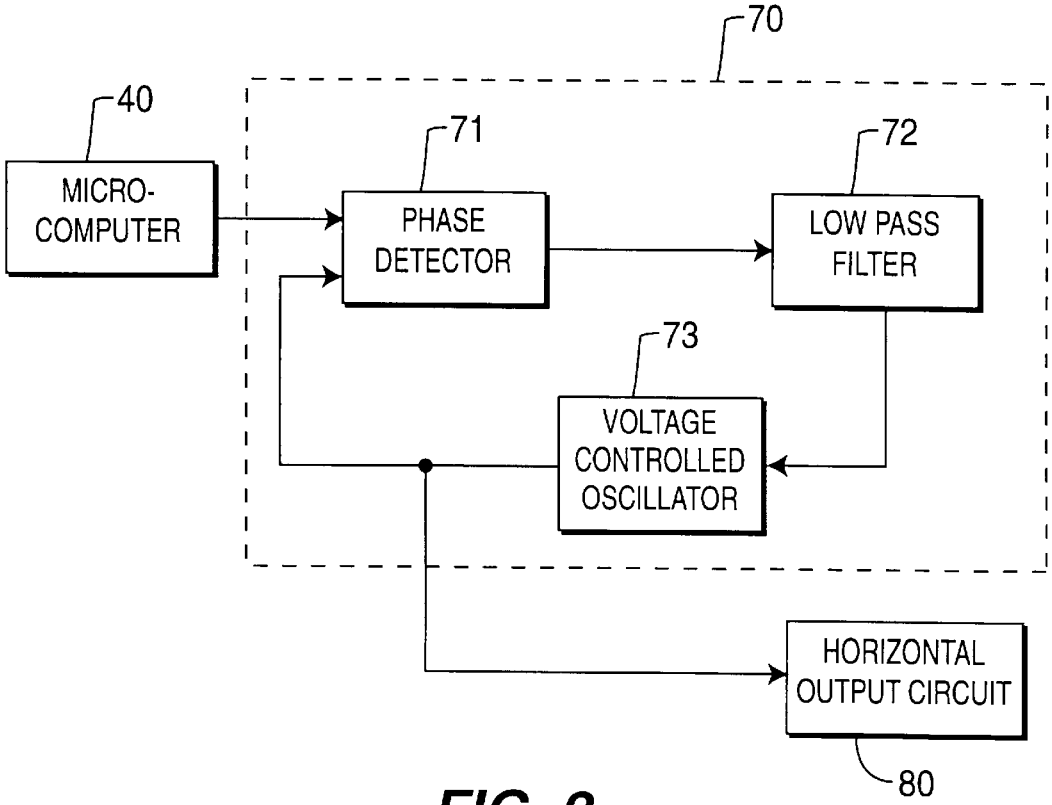
FIG. 2 is a detailed block diagram of a horizontal drive circuit of the video display device as shown in FIG. 1.

FIG. 2 illustrates a phase locked loop (PLL) circuit in the horizontal drive circuit 70 of the video display device as shown in FIG. 1. As shown in FIG. 2, the PLL circuit includes a phase detector 71 for comparing a phase of the horizontal synchronous signal H from the microcomputer 40 with that of the horizontal drive signal, a low pass filter 72 for low pass filtering an output signal from the phase detector 71 to convert the same into a direct current (DC) level signal, and a voltage controlled oscillator 73 for performing an oscillating operation in response to an output signal from the low pass filter 72 to generate the horizontal drive signal.

The operation of the PLL circuit in the horizontal drive circuit 70 of the video display device will now be described in detail hereinbelow.

First, the phase detector 71 compares the phase of the horizontal synchronous signal H from the microcomputer 40 with that of the horizontal drive signal from the voltage controlled oscillator 73. Then, the phase detector 71 detects a phase difference as a result of the comparison.

The low pass filter 72 low pass filters an output signal from the phase detector 71 to convert the same into a DC level signal, which is then applied to the voltage controlled oscillator 73. The voltage controlled oscillator 73 oscillates at a frequency and a phase based on the output signal level of the low pass filter 72 to produce the horizontal drive signal, which is then fed back to the phase detector 71 to be phase-compared with the horizontal synchronous signal H from the micro-computer 40. The horizontal drive signal from the voltage controlled oscillator 73 is also applied to the horizontal output circuit 80. That is, the PLL circuit in the horizontal drive circuit 70 is adapted to produce a horizontal drive signal with the same phase as that of the horizontal synchronous signal H from the micro-computer 40.

Figure 3:
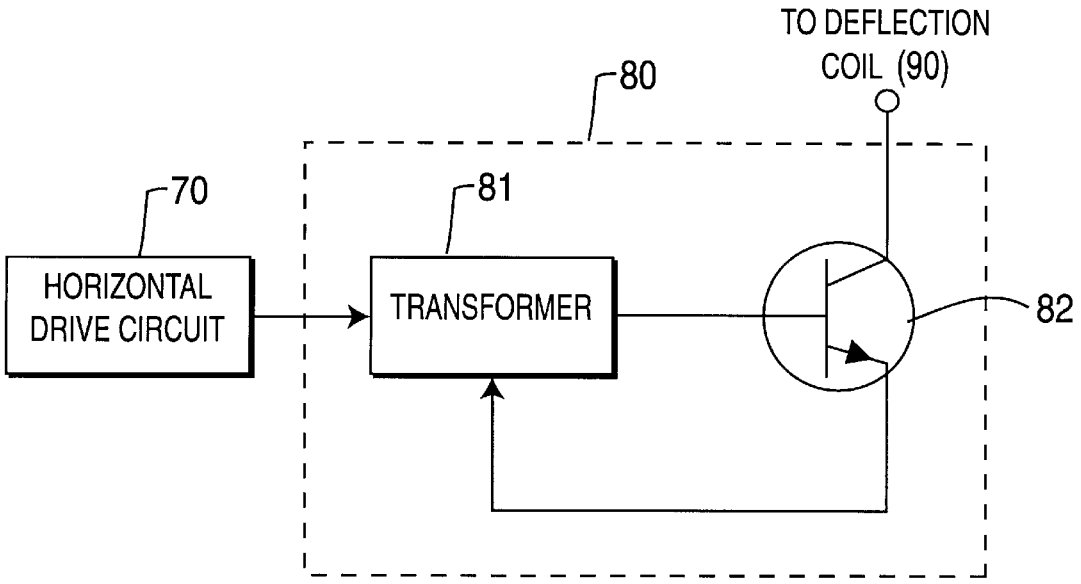
FIG. 3 is a detailed diagram of a horizontal output circuit of the video display device as shown in FIG. 1.

FIG. 3 illustrates a horizontal output circuit 80 of the video display device as shown in FIG. 1. As shown in FIG. 3, the horizontal output circuit 80 includes a transformer 81 for amplifying the horizontal drive signal from the voltage controlled oscillator 73 in the horizontal drive circuit 70, and a horizontal transistor 82 having its base for inputting an output signal from the transformer 81.

The horizontal transistor 82 is operated in response to the output signal from the transformer 81 to generate the horizontal deflection signal in order to cause the deflection coil 90 to generate the horizontal deflection magnetic field. As a result, the horizontal deflection of the electron beams generated by the CRT 100 is controlled by the horizontal deflection magnetic field of the deflection coil 90. However, when the operation mode of the video card 10 is changed, the horizontal transistor 82 is operated at a transient state because of variations of frequency of the horizontal synchronous signal. As a result, the horizontal transistor 82 is subjected to operational damage.

The reason that the horizontal transistor 82 is operated at the transient state with damage will now be described in detail hereinbelow.

The operation mode of the video card 10 is changed when the power is turned on or according to a user's selection. At this time, the operation mode of the video card 10 is changed from the present operation mode to a different operation mode such as a CGA mode, VGA mode or XGA mode. For example, in the case where the video card 10 installed in the computer system outputs horizontal and vertical synchronous signals in the VGA mode, the micro-computer 40 detects that a frequency of the horizontal synchronous signal is 31.47 KHz and a frequency of the vertical synchronous signal is 60 Hz and then determines that the present operation mode of the video card is the VGA mode. Then, the micro-computer 40 controls the entire operation of the video display device in the VGA mode.

When the operation mode of the video card 10 is changed from the VGA mode to the XGA mode and the video card 10 outputs horizontal and vertical synchronous signals of frequencies corresponding to the XGA mode, the micro-computer 40 detects that a frequency of the horizontal synchronous signal is 48.36 KHz and a frequency of the vertical synchronous signal is 60 Hz and then determines that the operation mode of the video card 10 has been changed to the XGA mode. Then, the micro-computer 40 produces the horizontal and vertical synchronous signals of the frequencies corresponding to the XGA mode.

Likewise, if the micro-computer 40 outputs the horizontal and vertical synchronous signals of the frequencies corresponding to the XGA mode in the VGA mode, the PLL circuit in the horizontal drive circuit 70 is operated at a transient state with the frequency of the horizontal drive signal varying. Namely, when the operation mode of the video card 10 is the VGA mode, the PLL circuit in the horizontal drive circuit 70 generates a horizontal drive signal of a phase synchronized with that of the horizontal synchronous signal of 31.47 KHz and outputs the horizontal drive signal to the horizontal output circuit 80. Under the same condition, when the operation mode of the video card 10 is changed from the VGA mode to the XGA mode and the video card 10 outputs the horizontal synchronous signal of 48.36 KHz, the phase of the horizontal drive signal from the voltage controlled oscillator 73 becomes different from that of the horizontal synchronous signal of 48.36 KHz. As a result, the PLL circuit is operated to generate a horizontal drive signal with a phase synchronized with that of the horizontal synchronous signal of 48.36 KHz.

At this time, the PLL circuit is operated at a transient state for a little time required in synchronizing the phase of the horizontal drive signal with that of the horizontal synchronous signal of 48.36 KHz. After the phase synchronization, the PLL circuit is normally operated in the XGA mode.

Figure 4:
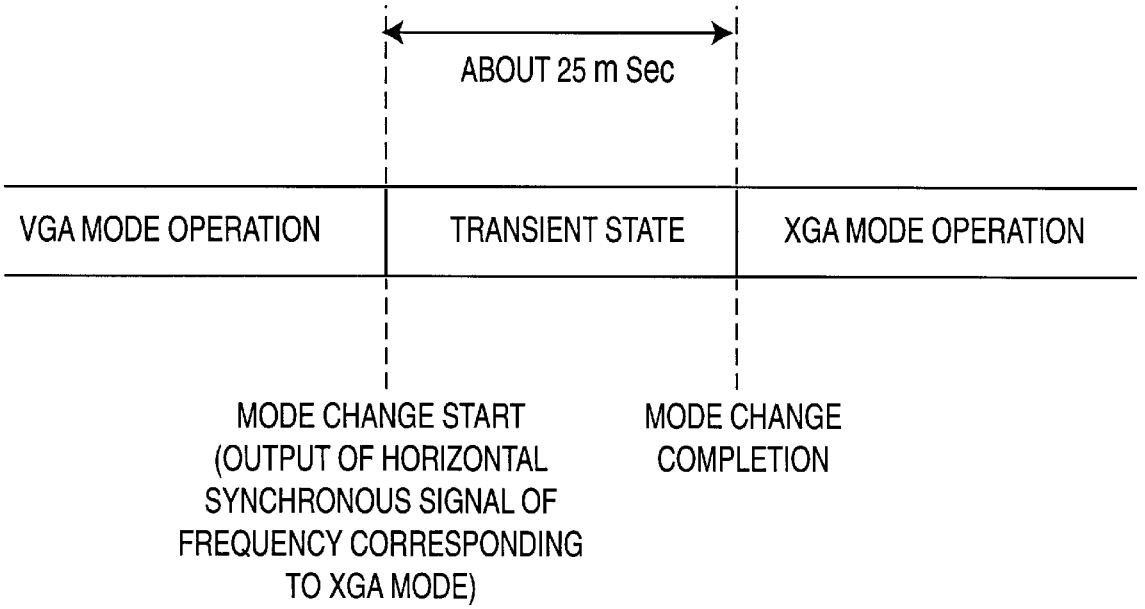
FIG. 4 illustrates a transient state of a horizontal transistor as shown in FIG. 3.

As shown in FIG. 4, the transient time is an interval from the variation in the horizontal synchronous signal frequency to the complete phase locking of the PLL circuit. Although the transient time is different according to the frequency of the horizontal synchronous signal, it is usually about 25msec.

The PLL circuit in the horizontal drive circuit 70 outputs an instable horizontal drive signal for the transient time. The instable horizontal drive signal from the PLL circuit is amplified by the transformer 81 in the horizontal output circuit 80 and then applied to the base of the horizontal transistor 82 in the horizontal output circuit 80. As a result, the horizontal transistor 82 is unstably operated.

Then, the deflection coil 90 generates an instable horizontal deflection magnetic field in response to the output signal from the horizontal transistor 82, thereby causing an instable picture to be displayed on the screen of the CRT 100. In addition, a voltage level of the horizontal drive signal generated for the transient time often exceeds a rated voltage level of the horizontal transistor 82, which may damage the horizontal transistor 82.

As described above, when the operation mode of the video card is changed, the PLL circuit is operated at the transient state, typically resulting in damage in the horizontal transistor. Usually, the after-sales servicing request for the video display device resulting from the damage of the horizontal transistor accounts for 30% of all after-sales servicing requests. For this reason, such a problem must be resolved efficiently in a cost effective manner.

Separately, when the operation mode of the video card is changed, the transient phenomenon occurs even with respect to the vertical synchronous signal similarly to the horizontal synchronous signal. However, the vertical synchronous signal has a small frequency variation within the range of 50 to 70 Hz according to operation modes of the video card 10. Further, the vertical synchronous signal has a frequency much lower than that of the horizontal synchronous signal. As a result, when the operation mode of the video card 10 is changed, the frequency variation of the vertical synchronous signal does not affect operation of a vertical transistor. Therefore, the vertical transistor can normally be operated regardless of the change in the operation mode of the video card 10.

Figure 5:
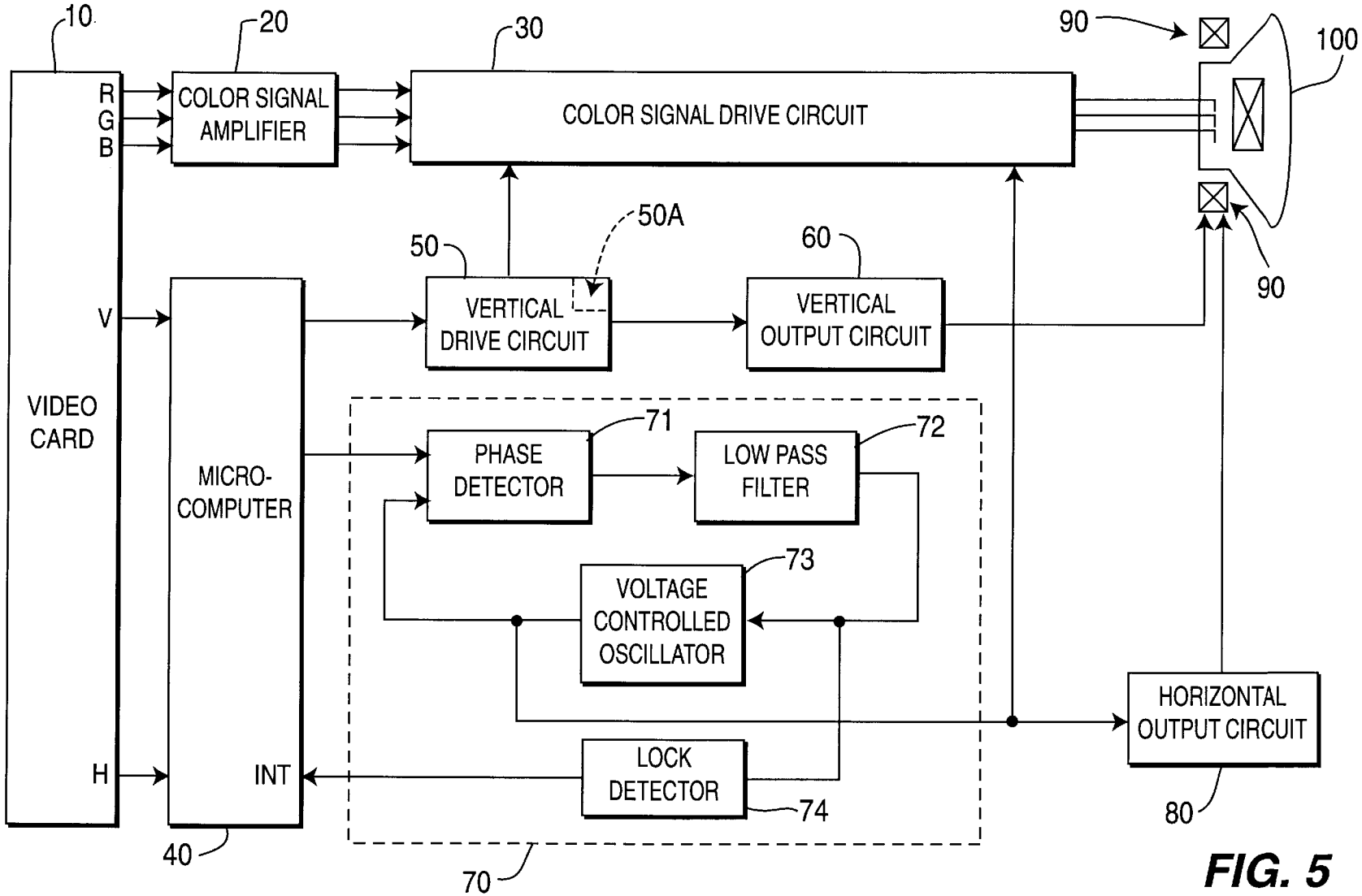
FIG. 5 is a block diagram of a video display device with a transient stabilizing feature as constructed according to the principles of the present invention.
Figure 6A:
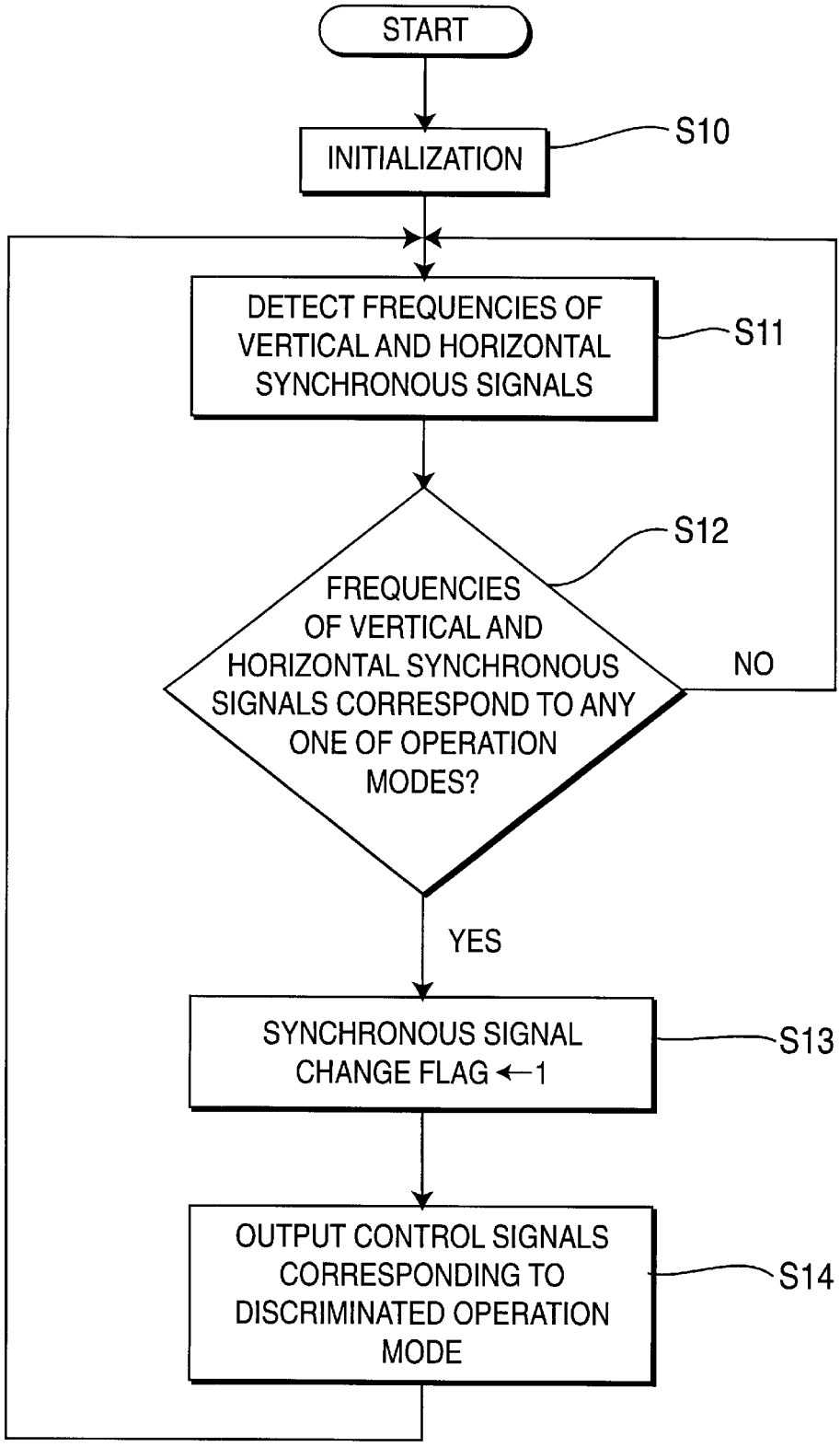
FIGS. 6A and 6B illustrate a stabilizing process of the present invention, including a flowchart of a main routine, and a flowchart of an interrupt routine when a transient phenomenon occurs.
Figure 6B:
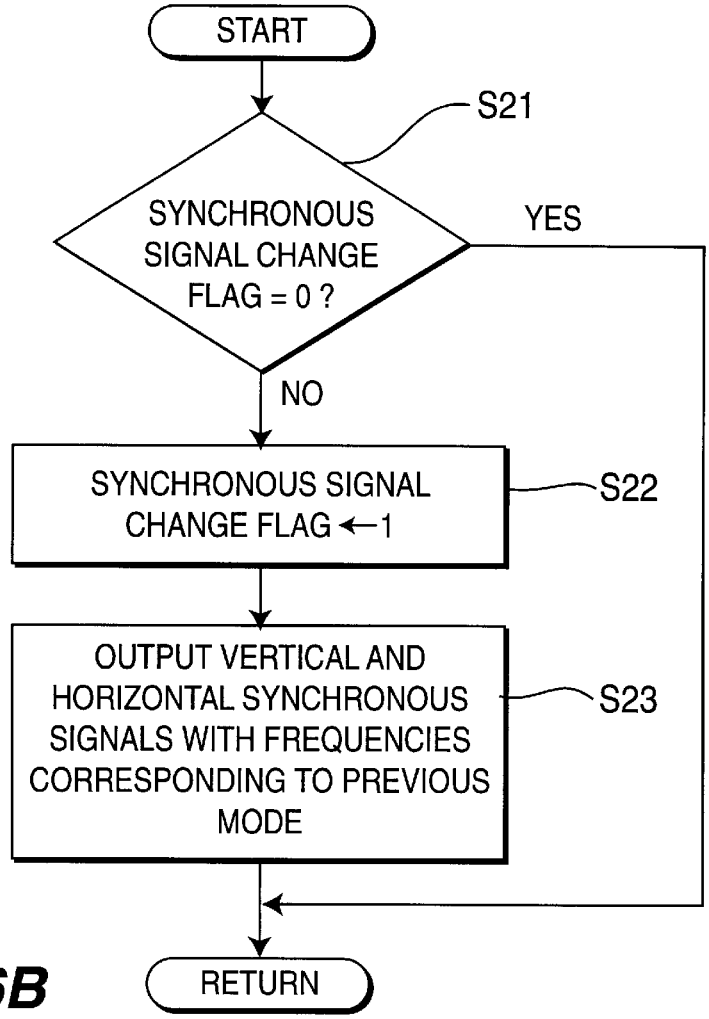
Figure 7:
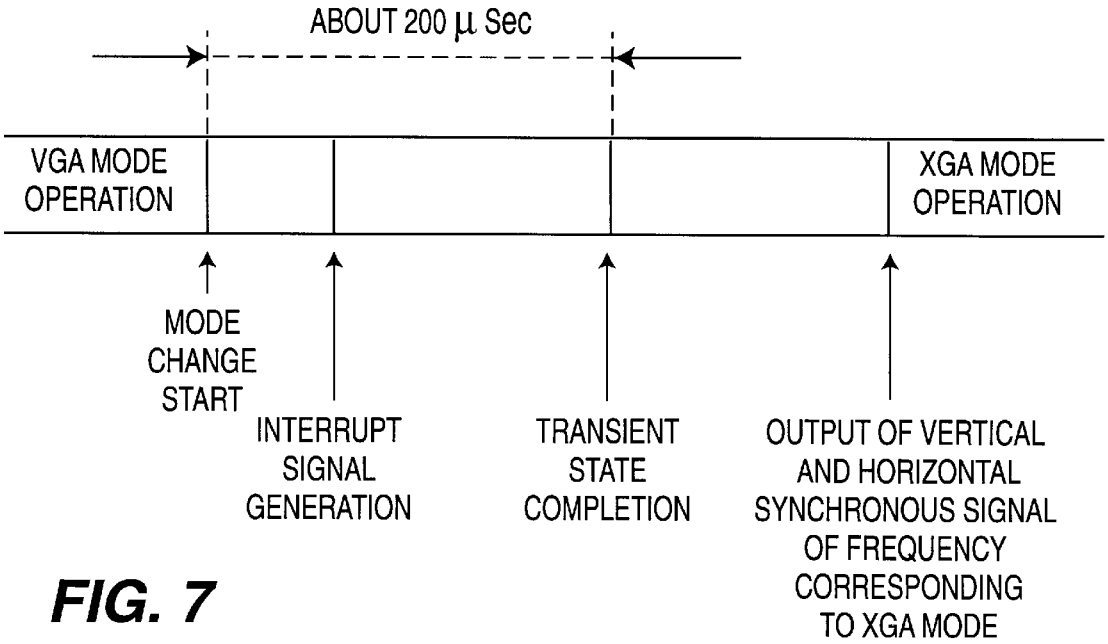
FIG. 7 illustrates operation of a micro-computer of a video display device constructed according to the principles of the present invention upon occurrence of a transient phenomenon.

Turning now to FIGS. 5 to 7 which illustrate a device and process of stabilizing a horizontal transistor of a video display device according to the principles of the present invention.

FIG. 5 illustrates a video display device having a transient stabilizing feature as constructed according to the principles of the present invention. As shown in FIG. 5, the video display device includes a video card 10 installed in a computer system, a color signal amplifier 20 for amplifying video signals R, G and B from the video card 10, and a color signal drive circuit 30 for processing output signals from the color signal amplifier 20 and outputting the processed signals to a CRT 100. A micro-computer 40 discriminates an operation mode of the video card 10 in response to frequencies of vertical and horizontal synchronous signals V and H from the video card 10 in order to control the entire operation of the video display device in a discriminated operation mode and to produce vertical and horizontal synchronous signals V and H in the discriminated operation mode. A vertical drive circuit 50 including a phase locked loop circuit 50*a* is connected to the micro-computer 40 for processing the vertical synchronous signal V from the micro-computer 40 to produce a vertical drive signal. A vertical output circuit 60 is connected to the vertical drive circuit 50 for generating a vertical deflection signal in response to the vertical drive signal from the vertical drive circuit 50 and applying the generated vertical deflection signal to a deflection coil 90 to deflect electron beams generated by the CRT 100 vertically. A horizontal drive circuit 70 is connected to the micro-computer 40 for processing the horizontal synchronous signal H from the micro-computer 40 to produce a horizontal drive signal. A horizontal output circuit 80 is then connected to the horizontal drive circuit 70 for generating a horizontal deflection signal in response to the horizontal drive signal from the horizontal drive circuit 70 and applying the generated horizontal deflection signal to the deflection coil 90 to deflect the electron beams generated by the CRT 100 horizontally.

The horizontal drive circuit 70 includes a PLL circuit which is operated at a phase locked state in response to the horizontal synchronous signal H from the micro-computer 40 to produce the horizontal drive signal. The PLL circuit is provided with a phase detector 71, a low pass filter 72 and a voltage controlled oscillator 73.

A lock detector 74 is provided to detect the phase locked state of the PLL circuit in the horizontal drive circuit 70 to generate an interrupt signal when the PLL circuit is operated at a transient state because it is not operated at the phase locked state. Namely, the lock detector 74 is means for detecting the transient state of the PLL circuit in the horizontal drive circuit 70. Upon receiving the interrupt signal from the lock detector 74, the microcomputer 40 outputs vertical and horizontal synchronous signals of frequencies before a change in the operation mode of the video card 10.

The operation of the video display device constructed according to the principles of the present invention will now be described in detail hereinbelow.

The color signal amplifier 20 amplifies the video signals R, G and B from the video card 10, and the color signal drive circuit 30 processes the amplified color signals from the color signal amplifier 20 in response to the output signals from the vertical and horizontal drive circuits 50 and 70 and outputs the processed color signals to the CRT 100.

The vertical and horizontal synchronous signals V and H from the video card 10 are applied to the micro-computer 40. The micro-computer 40 detects frequencies of the applied vertical and horizontal synchronous signals V and H and discriminates the operation mode of the video card 10 according to the detected frequencies. In addition, the micro-computer 40 transfers the applied vertical and horizontal synchronous signals V and H to the vertical and horizontal drive circuits 50 and 70, respectively.

The vertical drive circuit 50 processes the vertical synchronous signal V from the micro-computer 40 to produce the vertical drive signal to the color signal drive circuit 30 and vertical output circuit 60. The vertical output circuit 60 generates the vertical deflection signal in response to the vertical drive signal from the vertical drive circuit 50 and applies the generated vertical deflection signal to the deflection coil 90.

In the PLL circuit of the horizontal drive circuit 70, the phase detector 71 receives the horizontal synchronous signal H from the micro-computer 40 and compares a phase of the received horizontal synchronous signal H with that of the horizontal drive signal from the voltage controlled oscillator 73 to detect a phase difference therebetween. The low pass filter 72 low pass filters an output signal from the phase detector 71 to convert it into a DC level signal, which is then applied to the voltage controlled oscillator 73. As a result, the voltage controlled oscillator 73 outputs a horizontal drive signal with the same phase as that of the horizontal synchronous signal H from the micro-computer 40. Then, the horizontal output circuit 80 generates the horizontal deflection signal in response to the horizontal drive signal from the voltage controlled oscillator 73 and applies the generated horizontal deflection signal to the deflection coil 90.

Then, the CRT 100 generates the electron beams in response to the output signals from the color signal drive circuit 30. The generated electron beams are deflected vertically and horizontally by vertical and horizontal deflection magnetic fields generated by the deflection coil 90, thereby allowing a desired image to be displayed on a screen of the CRT 100.

In the case where the PLL circuit is not operated at the phase locked state, the phase difference detected by the phase detector 71 becomes large, resulting in an increase in level of the output signal from the phase detector 71. As a result, the DC level of the output signal from the low pass filter 72 becomes large in variation. However, in the case where the PLL circuit is operated at the phase locked state, the phase difference detected by the phase detector 71 becomes very small. As a result, the DC level of the output signal from the low pass filter 72 becomes very small in variation. The lock detector 74 detects the phase locked state of the PLL circuit on the basis of a variation in the DC level of the output signal from the low pass filter 72. When the variation in the DC level of the output signal from the low pass filter 72 exceeds a predetermined value, the lock detector 74 generates the interrupt signal.

In other words, when the frequency of the horizontal synchronous signal H from the micro-computer 40 is varied due to a change in the operation mode of the video card 10, a large phase difference is present between the horizontal synchronous signal H and the horizontal drive signal from the voltage controlled oscillator 73. Such a phase difference is detected by the phase detector 71 and low pass filtered by the low pass filter 72 which then outputs a DC voltage of a level varied according to the phase difference. The lock detector 74 detects the level variation of the DC voltage from the low pass filter 72 and thus generates the interrupt signal. Then, the lock detector 74 applies the generated interrupt signal to an interrupt terminal INT of the micro-computer 40.

If the interrupt signal from the lock detector 74 is applied to the interrupt terminal INT, the micro-computer 40 discriminates that the PLL circuit is operated at the transient state because of no phase locked state. Then, the microcomputer 40 operates a synchronous signal generator (not shown) therein to generate vertical and horizontal synchronous signals with frequencies before the mode change.

The vertical and horizontal synchronous signals from the microcomputer 40 are applied to the vertical and horizontal drive circuits 50 and 70, respectively, to allow the PLL circuit to be stably operated at the phase locked state.

Under the condition that the PLL circuit is stably operated at the phase locked state, the micro-computer 40 may continuously output the vertical and horizontal synchronous signals with the frequencies of the previous mode. Alternatively, the microcomputer 40 may output the vertical and horizontal synchronous signals with the frequencies of the previous mode and then vertical and horizontal synchronous signals with frequencies of the changed mode when a predetermined time period has elapsed.

FIG. 6A illustrates a main routine in a stabilizing method of the present invention. First, at step S10, the microcomputer 40 performs an initialization operation to initialize a synchronous signal change flag and other parameters. Then, the microcomputer 40 detects frequencies of vertical and horizontal synchronous signals from the video card 10 installed in the computer system at step S11.

At step S12, the micro-computer 40 discriminates whether the frequencies of the vertical and horizontal synchronous signals detected at step S11 correspond to any one of a plurality of operation modes of the video display device. Namely, the micro-computer 40 discriminates whether the frequencies of the received vertical and horizontal synchronous signals are within the range in which the video display device is operable.

If the frequencies of the received vertical and horizontal synchronous signals are not within the range in which the video display device is operable at step S12, the microcomputer 40 returns to step S11 to repeat the above operation. However, if the frequencies of the received vertical and horizontal synchronous signals are within the range in which the video display device is operable at step S12, the microcomputer 40 sets the synchronous signal change flag to "1" at step S13. Then, at step S14, the microcomputer 40 outputs control signals corresponding to the operation mode discriminated at step S12 to the vertical and horizontal drive circuits 50 and 70 to perform the operation in the discriminated operation mode.

FIG. 6B illustrates an interrupt routine in the stabilizing method of the present invention. Upon receiving the interrupt signal at the interrupt terminal INT in the middle of the main routine because of no phase locked state of the PLL circuit resulting from a change in the operation mode of the video card 10, the microcomputer 40 checks at step S21 whether the synchronous signal change flag has been reset to "0".

In the case where it is checked at the above step S21 that the synchronous signal change flag has been reset to "0", the microcomputer 40 returns to the main routine. However, in the case where it is checked at the above step S21 that the synchronous signal change flag has not been reset to "0", the microcomputer 40 resets the synchronous signal change flag to "0" at step S22 and generates vertical and horizontal synchronous signals with frequencies before the mode change at step S23. Then, the microcomputer 40 returns to the main routine.

FIG. 7 illustrates operation of the microcomputer 40 of the video display device constructed according to the principles of the present invention when a transient phenomenon occurs. When the operation mode of the video card 10 is changed from a VGA mode from an XGA mode and the horizontal synchronous signal is thus varied in frequency, the lock detector 74 detects that the PLL circuit is not operated at the phase locked state and thus applies the interrupt signal to the microcomputer 40.

In response to the interrupt signal from the lock detector 74, the microcomputer 40 operates the synchronous signal generator therein to generate vertical and horizontal synchronous signals with frequencies of the previous mode. The vertical and horizontal synchronous signals from the microcomputer 40 are applied to the vertical and horizontal drive circuits 50 and 70, respectively, to allow the PLL circuit to be stably operated at the phase locked state. Noticeably, about 200 u sec is required from the variation in the horizontal synchronous signal frequency to the complete phase locking of the PLL circuit.

If the PLL circuit is normally operated at the phase locked state as described, the micro-computer 40 generates vertical and horizontal synchronous signals with frequencies of the changed mode to allow the video display device for operation in the changed mode. The lock detector detects the transient state of the PLL circuit resulting from a change in the operation mode of the video card in the computer system and the micro-computer outputs vertical and horizontal synchronous signals with frequencies of the previous mode to allow the PLL circuit to be stably operated at the phase locked state. Therefore, the horizontal transistor is always applied with a rated voltage at its base so that it can be stably operated and is protected from operational damage.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof Therefore, it is intended that the present invention not be limited to the particular embodiment disclosed as the best mode contemplated for carrying out the present invention, but that the present invention includes all embodiments falling within the scope of the appended claims.

What is claimed is:

1. A video display device, comprising:

a monitor including a deflection coil;

a controller coupled to receive vertical and horizontal synchronous signals from a video card installed in a computer system, for discriminating an operation mode of said video card in response to frequencies of the vertical and horizontal synchronous signals and controlling operation of said video display device in a discriminated operation mode;

a vertical drive circuit including a first phase locked loop circuit for performing a phase locked operation in response to the vertical synchronous signal to produce a vertical drive signal;

a vertical output circuit for generating a vertical deflection signal in response to the vertical drive signal from said first phase locked loop circuit and applying the vertical deflection signal to said deflection coil to deflect electron beams generated by said monitor in a vertical direction;

a horizontal drive circuit including a second phase locked loop circuit for performing a phase locked operation in response to the horizontal synchronous signal to produce a horizontal drive signal;

a horizontal output circuit for generating a horizontal deflection signal in response to the horizontal drive signal from said second phase locked loop circuit and applying the horizontal deflection signal to said deflection coil to deflect electron beams generated by said monitor in a horizontal direction;

a transient state detector for detecting a transient state of said second phase locked loop circuit in response to a change in the operation mode of said video card; and said controller generating the vertical and horizontal synchronous signals with frequencies corresponding to an operation mode of said video display device before the change in the operation mode of said video card, when said transient state detector detects the transient state of said second phase locked loop circuit.

2. The video display device of claim 1, further comprised of said transient state detector detecting the transient state of said second phase locked loop circuit according to direct current level variation based on a phase difference between the horizontal synchronous signal from said controller and the horizontal drive signal from said second phase locked loop circuit.

3. The video display device of claim 1, further comprised of said controller generating the vertical and horizontal synchronous signals with frequencies corresponding to the changed operation mode of said video card, when said transient state detector detects no transient state of said second phase locked loop circuit.

4. The video display device of claim 1, further comprised of said second phase locked loop circuit comprising:

a phase detector for detecting a phase difference between the horizontal synchronous signal and the horizontal drive signal to produce a phase difference signal;

a low pass filter for low pass filtering said phase difference signal to produce a direct current level signal; and a voltage controlled oscillator for generating said horizontal drive signal having the same phase as the horizontal synchronous signal in response to the direct current level signal.

5. The video display device of claim 4, further comprised of said horizontal output circuit comprising:

a transformer for amplifying the horizontal drive signal from the voltage controlled oscillator in the horizontal drive circuit; and a horizontal transistor having a base connected to the transformer for generating the horizontal deflection signal to cause the deflection coil to generate a horizontal deflection magnetic field for forming an image on said monitor.

6. The video display device of claim 1, further comprised of said vertical and horizontal synchronous signals exhibiting different frequencies according to different operation modes of the video card, including a color graphics adapter mode, a video graphics adapter mode, and an extended graphics adapter mode.

7. The video display device of claim 6, further comprised of said vertical and horizontal synchronous signals exhibiting frequencies of 60 Hz and 15.75 KHz respectively, when said video card operates in said color graphics adapter mode, exhibiting frequencies of 60 Hz and 31.47 KHz, respectively, when said video card operates in said video graphics adapter mode, and alternatively exhibiting frequencies of 60 Hz and 48.36 KHz, respectively, when said video card operates in said extended graphics adapter mode.

8. The video display device of claim 1, further comprising:

a video amplifier for amplifying video signals received from the video card; and a video drive circuit for driving amplified video signals in response to the vertical and horizontal synchronous signals for a visual display on said monitor.

9. A method for stabilizing a horizontal transistor of a video display device, comprising the steps of:

receiving vertical and horizontal synchronous signals from a video card installed in a computer system and discriminating whether the vertical and horizontal synchronous signals received from said video card exhibit frequencies corresponding to an operation mode of said video display device;

generating control signals corresponding to an operation mode of said video card to control operation of said video display device, when the vertical and horizontal synchronous signals received from said video card exhibit frequencies corresponding to the operation mode of said video display device; and generating vertical and horizontal synchronous signals with frequencies corresponding to the operation mode of said video display device before a change in the operation mode of said video card, when an interrupt signal is generated in response to the change in the operation mode of said video card.

10. The method of claim 9, further comprising the step of: generating vertical and horizontal synchronous signals with frequencies corresponding to the change in the operation mode of said video card, when the interrupt signal is not generated after the vertical and horizontal synchronous signals with the frequencies corresponding to the operation mode of said video display device before the change in the operation mode of said video card are generated.

11. A video display device, comprising:

a monitor including a deflection coil;

a controller coupled to receive vertical and horizontal synchronous signals from a video card installed in a computer system, for determining whether said video card operates in one of a color graphics adapter mode, a video graphics adapter mode, and an extended graphics adapter mode in response to frequencies of the vertical and horizontal synchronous signals so as to control operation of said video display device in a determined mode of operation;

a vertical deflection circuit for generating a vertical deflection signal in response to the vertical synchronous signal to said deflection coil to deflect electron beams generated by said monitor in a vertical direction;

a horizontal deflection circuit for generating a horizontal deflection signal in response to the horizontal synchronous signal to said deflection coil to deflect electron beams generated by said monitor in horizontal direction, said horizontal deflection circuit including a phase locked loop circuit for performing a phase locked operation in response to the horizontal synchronous signal, and a transient state detector for detecting a transient state of said phase locked loop circuit in response to a change in the determined mode of operation of said video card; and said controller generating the vertical and horizontal synchronous signals with frequencies corresponding to an operation mode of said video display device before the change in the determined mode of operation of said video card, when said transient state detector detects the transient state of said phase locked loop circuit.

12. The video display device of claim 11, further comprised of said transient state detector detecting the transient state of said phase locked loop circuit according to direct current level variation based on a phase difference between the horizontal synchronous signal from said controller and a horizontal drive signal from said phase locked loop circuit.

13. The video display device of claim 12, further comprised of said controller generating the vertical and horizontal synchronous signals with frequencies corresponding to the changed mode of operation of said video card, when said transient state detector detects no transient state of said phase locked loop circuit.

14. The video display device of claim 13, further comprised of said phase locked loop circuit comprising:

a phase detector for detecting a phase difference between the horizontal synchronous signal and the horizontal drive signal to produce a phase difference signal;

a low pass filter for low pass filtering said phase difference signal to produce a direct current level signal; and a voltage controlled oscillator for generating said horizontal drive signal having the same phase as the horizontal synchronous signal in response to the direct current level signal.

15. The video display device of claim 14, further comprised of said horizontal deflection circuit including a horizontal output circuit comprising:

a transformer for amplifying the horizontal drive signal from the voltage controlled oscillator; and a horizontal transistor having a base connected to the transformer for generating the horizontal deflection signal to cause the deflection coil to generate a horizontal deflection magnetic field for forming an image on said monitor.

16. The video display device of claim 11, further comprised of said vertical and horizontal synchronous signals exhibiting different frequencies depending upon whether said video card operates in one of said color graphics adapter mode, said video graphics adapter mode, and said extended graphics adapter mode.

17. The video display device of claim 16, further comprised of said vertical and horizontal synchronous signals exhibiting frequencies of 60 Hz and 15.75 KHz, respectively, when said video card operates in said color graphics adapter mode, exhibiting frequencies of 60 Hz and 31.47 KHz, respectively, when said video card operates in said video graphics adapter mode, and alternatively exhibiting frequencies of 60 Hz and 48.36 KHz, respectively, when said video card operates in said extended graphics adapter mode.

* * * * *